US005125386A

United States Patent [19]

De Filippis et al.

[11] Patent Number: 5,125,386

[45] Date of Patent: Jun. 30, 1992

[54] COIL IGNITION UNIT FOR AN INTERNAL COMBUSTION ENGINE

[75] Inventors: Pietro De Filippis; Franco Huwyler, both of Milan; Claudio Rondonotti; Gianfranco Ghilardi, both of Cinisello Balsamo; Sergio Memini, Sesto San Giovanni, all of Italy

[73] Assignee: Industrie Magneti Marelli SpA, Milan, Italy

[21] Appl. No.: 696,798

[22] Filed: May 7, 1991

[30] Foreign Application Priority Data

May 7, 1990 [IT] Italy ..... 67334 A/90

[51] Int. Cl.[5] ..... F02P 3/02

[52] U.S. Cl. ..... 123/634; 123/635; 123/643; 336/226

[58] Field of Search ..... 123/634, 635, 643; 336/96, 226

[56] References Cited

U.S. PATENT DOCUMENTS 4,658,799 4/1987 Kusaka et al. ..... 123/634 X 4,706,639 11/1987 Boyer et al. ..... 123/143 C X

FOREIGN PATENT DOCUMENTS 2156595 10/1985 United Kingdom ..... 123/634

2156596 10/1985 United Kingdom ..... 123/634

*Primary Examiner*—Tony M. Argenbright

*Attorney, Agent, or Firm*—Sughrue, Mion, Zinn, Macpeak & Seas

[57] ABSTRACT

The ignition unit includes a support housing containing two ignition coils each for the connection to at least one, and preferably two, associated spark plugs. Each ignition coil comprises a primary winding and a second winding disposed around the end arms of a magnetic core or circuit formed by only two packs of plates juxtaposed so that together they form essentially a figure-of-8 shape. The packs of plates are identical, essentially E-shaped and are placed close together, face-to-face, so that together they form a squared figure-of-8 shape. Each of the packs of plates has a notch which extends from the back of the E into its central arm and almost up to the end of the free end thereof. Conveniently, inserts of non-magnetic material are disposed in the notches in the packs of plates.

20 Claims, 6 Drawing Sheets

COIL IGNITION UNIT FOR AN INTERNAL COMBUSTION ENGINE

BACKGROUND OF THE INVENTION

The present invention relates to an integrated coil ignition unit for an internal combustion engine, including a support housing containing two ignition coils each for connection to at least one, and preferably two, associated spark plugs and each comprising a primary winding and a secondary winding disposed around an arm of a respective magnetic core or circuit.

An integrated coil ignition unit of the type specified above is known from U.S. Pat. No. 4,706,639 in which each ignition coil has its own magnetic core or circuit of rectangular shape with a portion connecting the central regions of the longer sides of the rectangle. The associated ignition coil is disposed around this portion.

The connections between the secondary windings of the ignition coils and the output terminals of the unit are formed by conductors which are encapsulated in the insulating base wall of the unit housing and by springs connected to the conductors.

SUMMARY OF THE INVENTION

The object of the present invention is to provide a coil ignition unit of the type specified above which, in particular, has a simpler structure and can thus be produced more quickly, easily and cheaply.

According to the invention, these and other objects are achieved by a unit of the type specified above, whose main characteristic lies in the fact that the magnetic cores are formed by only two packs of plates which are juxtaposed so that, together, they form essentially a figure-of-8 shape, the two ignition coils being disposed around the end portions of the figure-of-8 shape.

Conveniently, the packs of plates are essentially E-shaped and are placed close together, face-to-face, so that together they form a squared figure-of-8 shape; each pack of plates also has a notch which extends from the back of the E into its central arm and almost up to the edge of the free end thereof.

To advantage, inserts of non-magnetic material are disposed in the notches defined in the packs of plates.

BRIEF DESCRIPTION OF THE DRAWINGS

Further characteristics and advantages of the invention will become clear from the detailed description which follows, with reference to the appended drawings, provided purely by way of non-limiting example, in which.

DETAILED DESCRIPTION OF THE INVENTION

Figure 1:
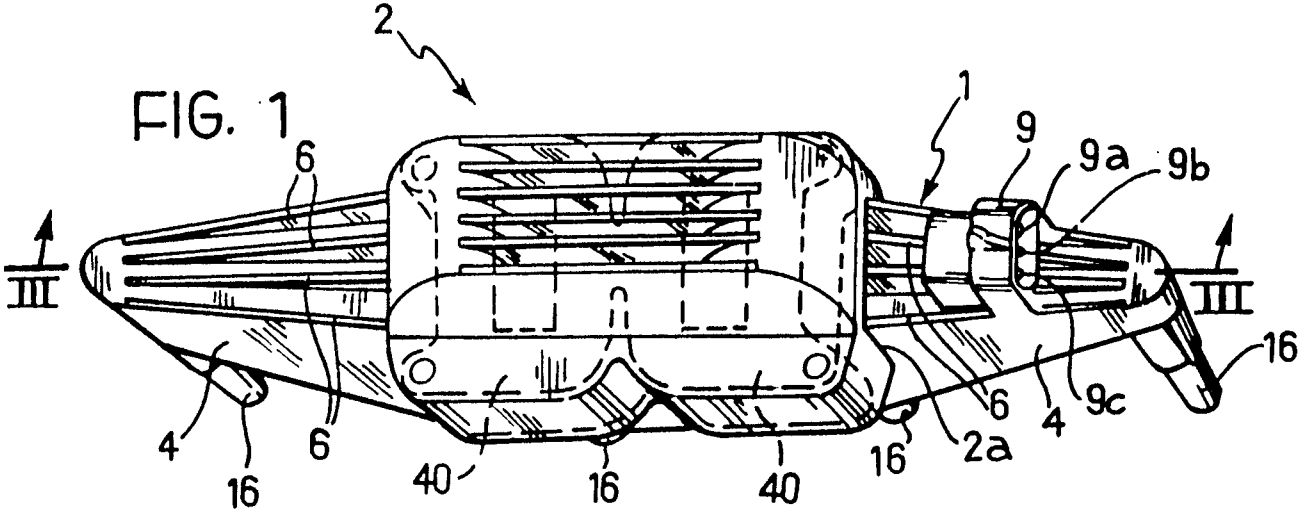
FIG. 1 is a perspective view of an integrated unit according to the invention.
Figure 2:
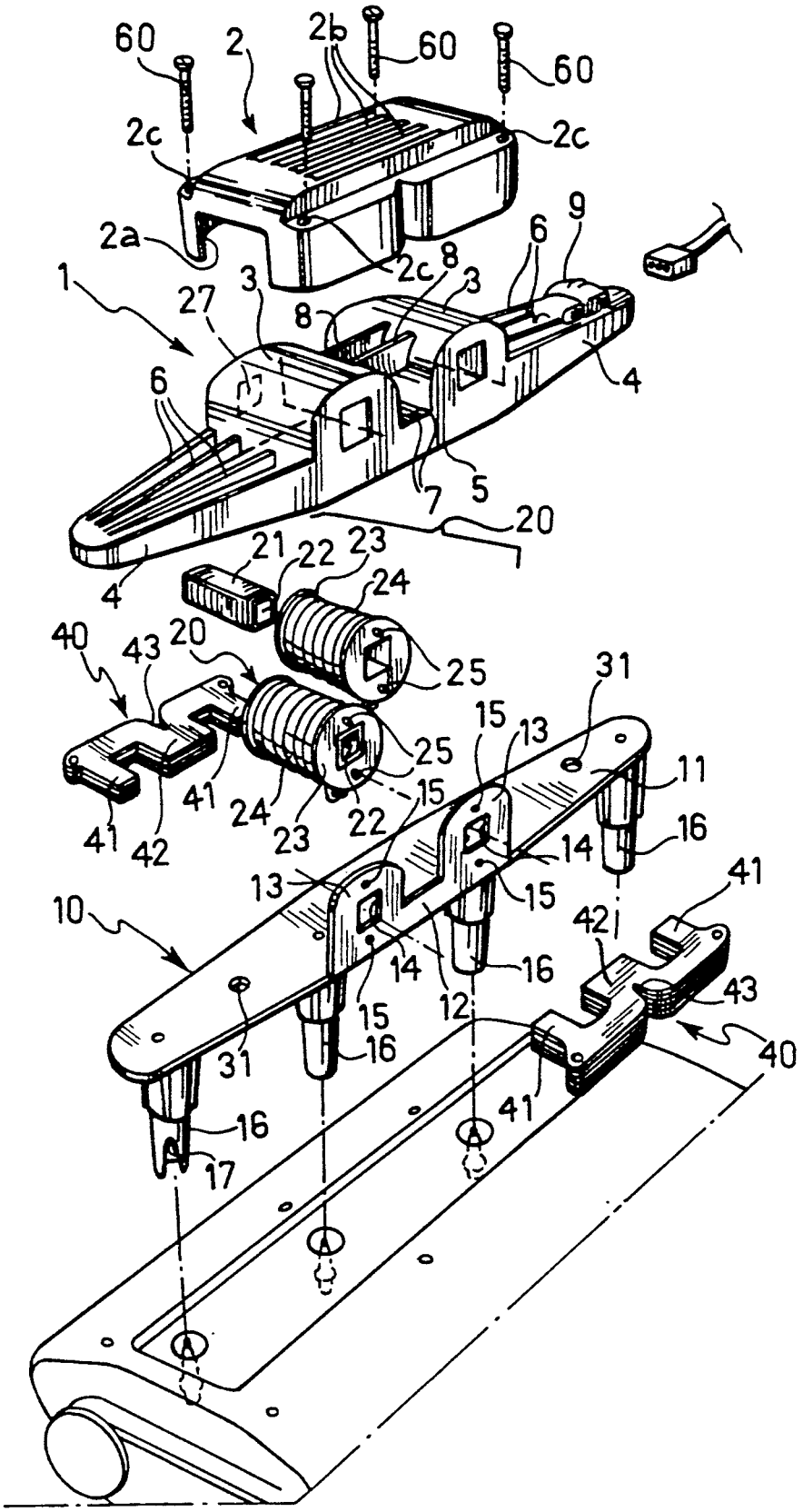
FIG. 2 is an exploded perspective view of the unit shown in FIG. 1.

With reference to FIGS. 1 and 2, in the embodiment illustrated, an integrated ignition unit according to the invention includes a housing 1 of plastic material, around whose central portion is fitted a casing 2 of non-magnetic material, for example aluminium.

Figure 3:
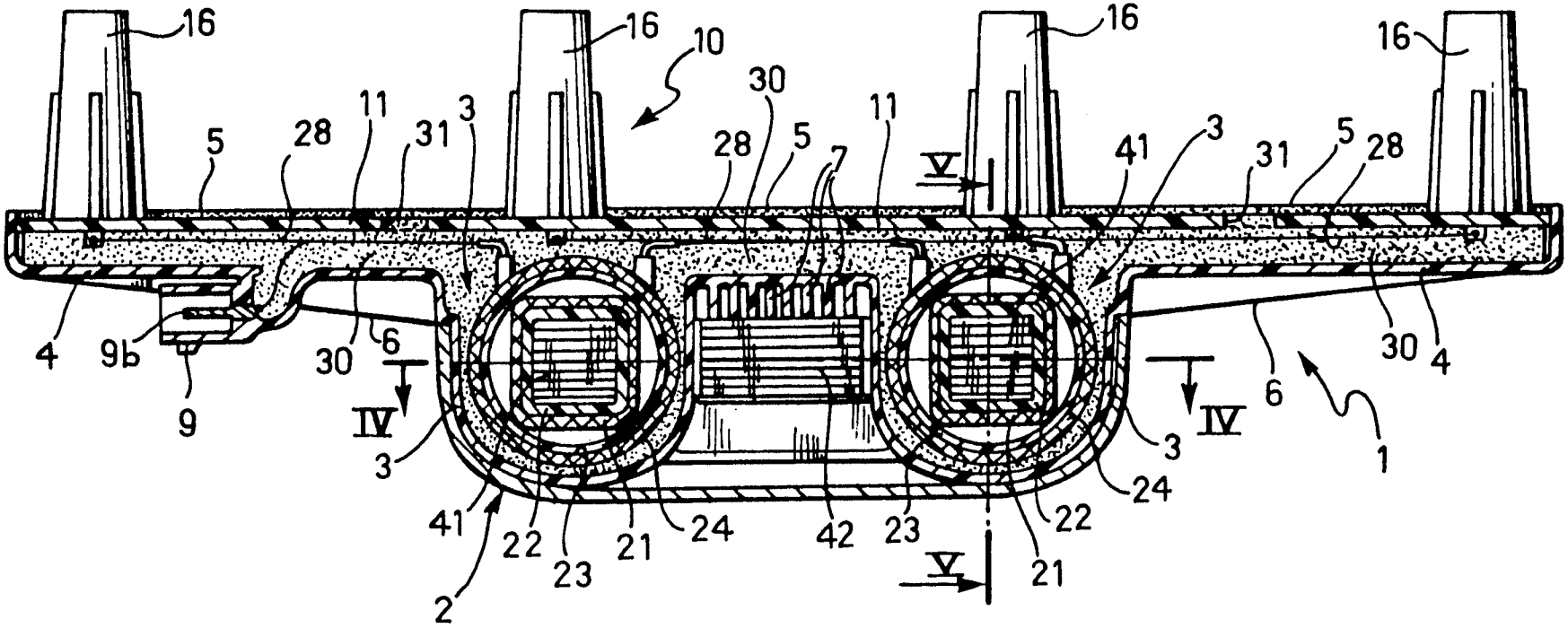
FIG. 3 is a section taken on the line III—III of FIG. 1.

As can seen in particular from FIGS. 2 and 3, the housing 1 is essentially dish-shaped and defines two adjacent cells, indicated 3 in its central region. The ends of the housing 1 form two concave beak-like projections 4 which extend in opposite directions, each from the top of a corresponding cell 3 (FIG. 3). The housing 1 as a whole defines an elongate coupling aperture 5 which opens from both the beak-like side projections 4 and the cells 3.

As can better be seen from FIG. 2, the beak-like projections 4 of the housing 1 have external longitudinal fins 6 for dissipating heat.

In the recess defined between the cells 3, the housing 1 has a series of transverse fins 7 (FIGS. 2 and 3) also for facilitating heat dissipation.

In the embodiment illustrated, two integral bridges 8 extend longitudinally between the outer surfaces of those walls of the cells 3 of the housing 1 spaced from the cooling fins 7.

Figure 1A:
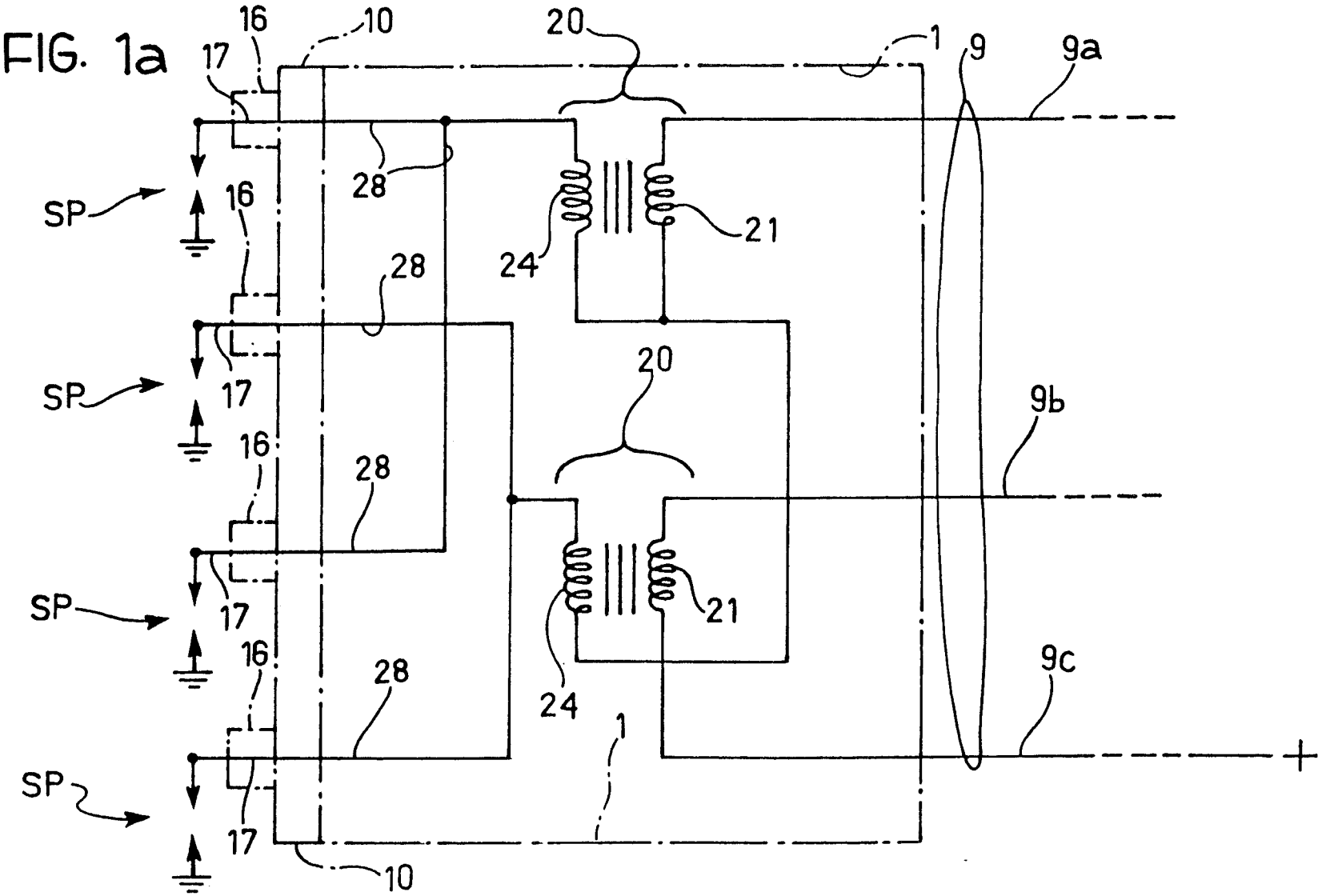
FIG. 1*a* is an electrical diagram of the integrated unit of FIG. 1.

A female electrical connector 9 is formed on the outer surface of one of the projections 4 of the housing 1 and is intended, as will become clearer from the following, to connect the primary windings of the ignition coils of the unit to earth and to two control outputs of an ignition-control module of known type, in particular, of the static-distribution type. In the embodiment illustrated, the connector 9 has three contacts, indicated 9*a*, 9*b* and 9*c* in FIGS. 1 and 1*a*, in the form of flat pins.

With reference to FIG. 2, the integrated unit also includes a closure and support member, generally indicated 10, having an elongate base plate or platform 11 whose shape corresponds substantially to that of the aperture 5 of the dish-shaped housing 1.

Conveniently, the closure and support member 10 is moulded from plastic material.

A wall 12 extends perpendicularly from the central portion of a longer side of the portion 11 of the member 10 and forms two appendages or flanges 13 each of which extends, in the assembled condition, into a respective cell 3 of the housing 1 adjacent the side wall of the housing. Each of the flanges has a central, substantially square hole 14 and two smaller holes 15 arranged on opposite sides of the hole 14.

Tubular projections, indicated 16, integral with the closure and support member 10, extend from that face of the plate 11 which faces away from the interior of the housing.

The projections 16 are intended for insertion in the recesses in the head of the internal combustion engine which house the spark plugs.

The projections 16, within each of which is fixed a connecting conductor member, indicated 17 in FIG. 2, constitute the output terminals of the integrated unit and are intended to engage the spark plugs so as to connect the plugs to the ignition coils of the integrated unit by means of the conductor members 17.

An ignition transformer or coil, generally indicated 20 in FIG. 2, is housed in each cell 3 of the housing 1.

Each ignition coil includes a primary winding 21 wound on a tubular spool 22 of plastic material. The primary winding thus formed is inserted in the spool 23 (also of plastic material) which carries the turns of the secondary winding 24.

A pair of pins or projections 25 extends from an end flange of each spool 23 and is engaged in the holes 15 in a respective flange 13 of the closure and support member 10. The portions of the pins which project beyond the holes in the associated flanges are deformed, for example by a hot blade, so as to connect the ignition coils 20 firmly to the flanges 13.

Figure 4:
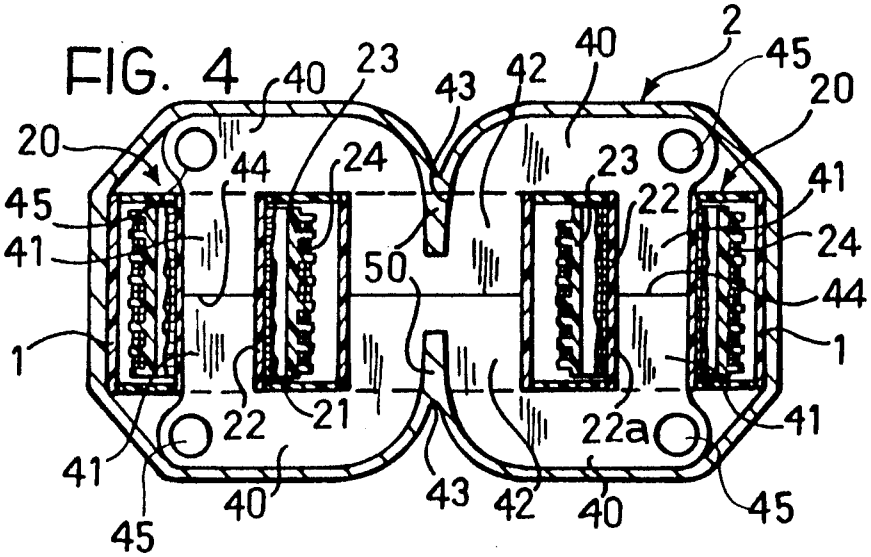
FIG. 4 is a section taken on the line IV—IV of FIG. 3.
Figure 5:
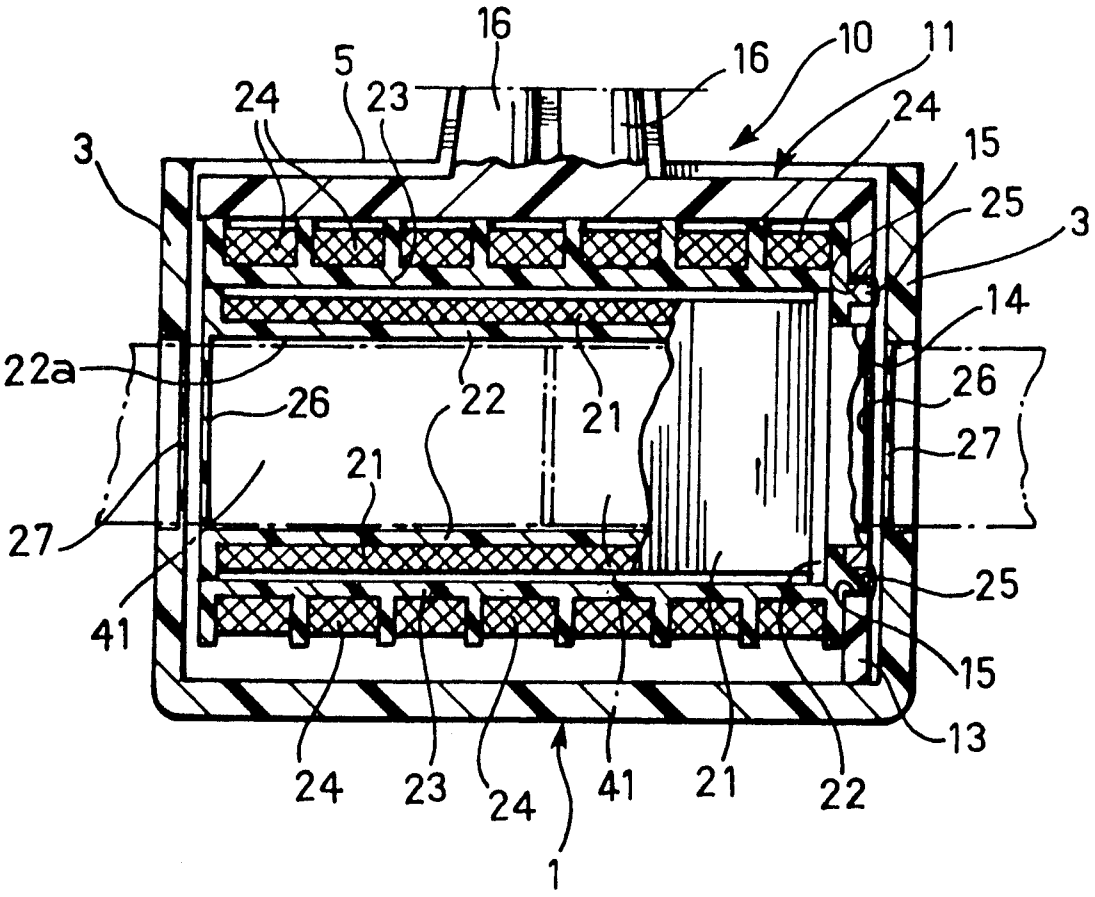
FIG. 5 is a section taken on the line V—V of FIG. 3.

In the embodiment of FIGS. 1 to 5, the ends of the spools 22 of the primary windings of the ignition coils are closed by breakable transverse partitions 26 (see FIG. 5, in particular).

Correspondingly, regions of the side walls of the housing 1 which face the partitions define thinner portions 27 which are also easily breakable (FIG. 5).

Locating projections are provided, in known manner, in the cells 3 of the housing 1 for ensuring that the ignition coils 20 are positioned correctly with the partitions 26 facing and adjacent the breakable portions 27 of the side walls of the housing.

In the embodiment illustrated, the ignition coils 20 are connected to the flanges 13 of the member 10 in the manner described above. The ends of the secondary windings 24 are connected to the conductor members 17 of the terminals or outputs 16 in the manner shown in FIG. 1*a* with the use of metal connecting wires indicated 28 in FIGS. 1*a* and 3. As can be seen in FIG. 3, conveniently, the conductors extend adjacent that face of the plate 11 of the support and guide member 10 which faces into the housing.

The wire conductors 28 are connected in known manner, for example, by soldering, to the windings of the ignition coils and to the conductor members 17 of the output terminals 16.

The ends of the primary windings 21 of the ignition coils are, however, connected to the terminals 9*a*-9*c* of the output connector 9, also with the use of soldered metal wires.

After the support and closure member 10 and the coils connected thereto have been positioned in the housing 1 and the electrical connections described above have been made, the housing 1 (arranged as in FIG. 3) is filled with an electrically-insulating material (for example, a resin) which is poured in in the liquid state and then set. This material is indicated 30 in FIG. 3.

The insulating material is poured into the housing through holes, such as those indicated 31 in FIGS. 2 and 3, formed in the base plate of the member 10. Conveniently, the quantity of insulating material poured in is such that it also covers the upper face of the plate 11 of the contact-holder member 10 uniformly, for example, to a depth of 2-3 mm.

During the pouring of the insulating material, the partitions 26 prevent the material from entering the cavities within the spools 22 of the primary windings 21 (FIG. 5).

Once the insulating filler material has set, the partitions 26 and 27 are removed so that the axial passages 22*a* (FIG. 5) defined within the spools 22 of the primary windings are accessible from outside the housing 1.

Two packs of plates, generally indicated 40 in FIGS. 2 and 4, can then be associated with the two ignition coils housed in the cells 3 of the housing 1.

As can be seen in these drawings, the packs of plates are identical and essentially E-shaped, each having two end arms 41 and a central arm 42.

The two packs of plates are placed close together, face-to-face, so that together they form a squared figure-of-8 shape.

The central arm 42 of each pack of plates has a deep notch 43 which extends from the back of the E almost to the edge of the free end of the central arm.

Air gaps 44 (FIG. 4) are formed between the facing end arms 41 of the two packs of plates.

Together, the two packs of plates described above form two ring-shaped magnetic cores or circuits which are interconnected mechanically. If the notches 43 formed in the packs of plates are quite deep, the two ring-shaped flux paths can in practice be considered as magnetically decoupled from each other.

After the breakable walls 26 and 27 described above have been removed, the packs of plates 40 are inserted in the unit so that their arms 41 project into the spools 22 of the primary windings and their central arms 42 extend outside the housing 1, between the cooling fins 7 and the bridges 8 described above (FIGS. 2 to 4).

The casing 2 of non-magnetic material is then connected to the outside of the housing 1 so as to surround and clamp the packs of plates 40 and prevent them from coming apart (FIGS. 1 and 4).

As can be seen in particular in FIGS. 1 and 2, the casing 2 has two end cut-outs 2*a* each of which houses a corresponding base portion of a beak-like projection 4 of the housing 1.

As can be seen in FIG. 3, in longitudinal section, the periphery of the internal surface of the casing 2 mates with the periphery of the outer surface of the corresponding portion of the housing 1 in which the cells 3 are formed. The casing 2 has its own set of cooling ribs or bridges 2*b* which are intercalated between the bridges 8 of the housing 1.

With reference to FIG. 4, the casing 2 has two internal, integral projections 50 which fit into the notches 43 in the two packs of plates. Since the casing 2 conveniently is made of non-magnetic material, its projections 50 help to decouple the two ring-shaped magnetic circuits associated with the two ignition coils 20. These circuits which, in practice, are thus decoupled from a magnetic point of view are nevertheless interconnected rigidly from a mechanical point of view.

The integrated unit described above can be fixed to the head of an internal combustion engine, for example, by means of four screws 60 (FIG. 2) extending through holes 2*c* provided for this purpose in the casing 2 and through corresponding holes 45 formed in the packs of plates 40.

A variant will now be described with reference to FIG. 6 in which parts and elements already described above have again been given the same reference numerals.

Figure 6:
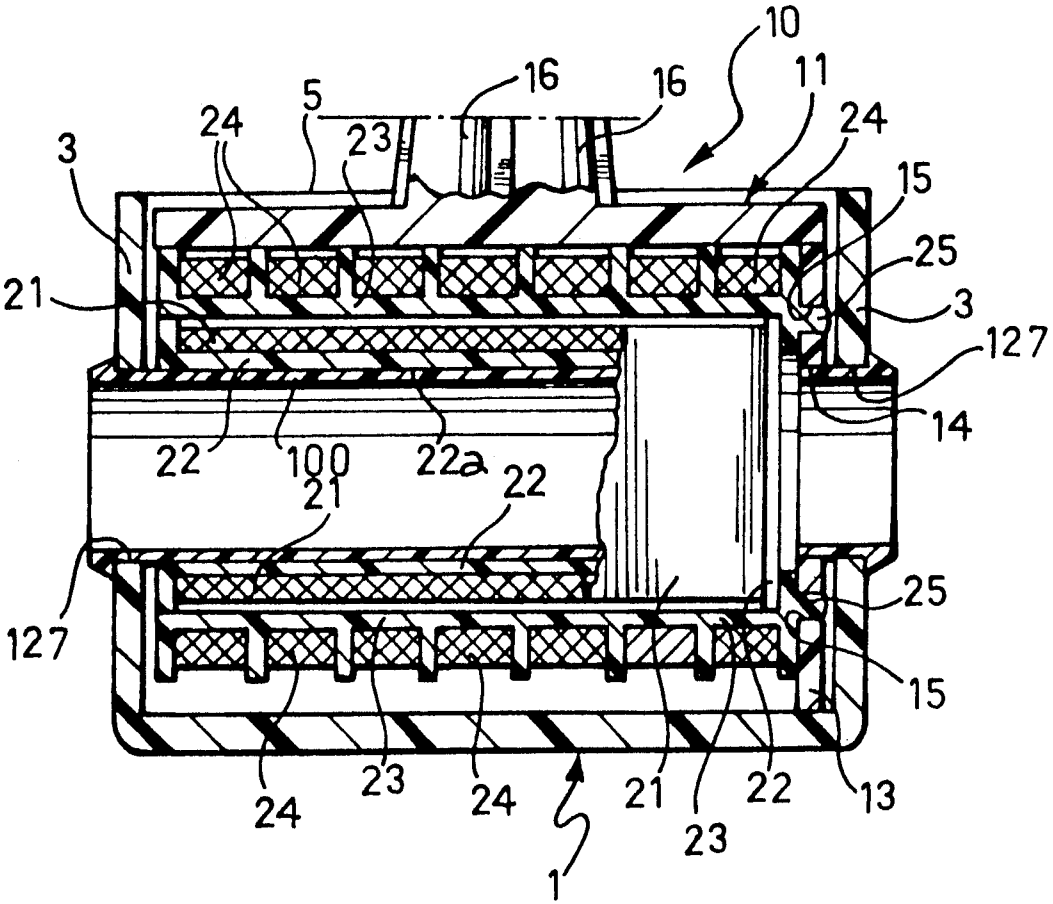
FIG. 6 is a section similar to that of FIG. 5, showing a partial variant of the integrated unit of FIGS. 1 to 5.

In the variant of FIG. 6, the spools 22 which carry the primary windings of the ignition coils have no end walls and the axial passages 22*a* defined therein are thus open. Correspondingly, the side walls have no partitions 27 at the ends of the cells 3 but instead they have apertures, indicated 127.

During assembly, once the unit formed by the closure and support member 10 and the ignition coils connected thereto has been assembled and positioned in the housing 1, tubular elements, indicated 100 in FIG. 6, are inserted through the apertures 127 in the housing and the spools 22 of the primary windings. Conveniently, these elements are made of plastic material and are longer than the distance between the facing walls of the cells 3 in which the apertures 127 are formed.

The ends of the tubular elements 100 which project out of the cells 3 are welded to the edges of the apertures 127 of the cells, for example, by ultrasonic or hot-blade welding.

Upon completion of this operation, in this variant, the insulating filler material is again poured in, in the manner described above. During this operation, the welding of the ends of the tubes 100 to the apertures 127 of the cells 3 of the housing 1 prevents leakage of the insulating material which is poured in in the liquid state.

The packs of plates 40 are then inserted and, in this variant, their end arms 41 project into the tubes 100 which have been welded into the apertures 127 of the cells in the manner described above.

In a manner similar to that described above, the assembled packs of plates are secured by the fitting of the non-magnetic casing 2 which also has the effect of decoupling the magnetic circuits associated with the two ignition coils magnetically.

In both of the embodiments described above, the integrated unit according to the invention has various merits and advantages.

In the first place, from a structural point of view, the magnetic circuits associated with the two ignition coils are formed with the use of only two, identical packs of plates. The packs of plates are easily clamped together by the connection of the aluminium casing or cover 2 as described above.

Although, in practice, the two ring-shaped magnetic circuits associated with the ignition coils are magnetically decoupled, they are nevertheless fixed together mechanically. This affords the whole unit greater solidity and better vibration-resistance.

The outer casing 2 helps to protect the unit from the environment without the need for expensive protective treatments. At the same time, the casing forms an effective screen for reducing the amount of radio interference generated in operation. Finally, the casing 2 also dissipates the heat evolved by the integrated unit in operation effectively.

Naturally, the principle of the invention remaining the same, the forms of embodiment and details of construction may be varied widely with respect to those described and illustrated purely by way of non-limiting example, without thereby departing from the scope of the present invention.

What is claimed is:

1. A coil ignition unit for an internal combustion engine including a support housing containing two ignition coils each for connection to at least one associated spark plug and each comprising a primary winding and a secondary winding disposed around an arm of a respective magnetic core or circuit, the magnetic cores being formed by only two packs of plates juxtaposed so that together they form essentially a figure-of-8 shape comprised of two ring-shaped portions, the ignition coils being disposed around the end portions of the figure-of-8 shape.

2. An ignition unit according to claim 1, wherein the packs of plates are essentially E-shaped with a central arm and two end arms and are placed close together, face-to-face, to form the squared figure-of-8 shape, each pack of plates having a notch which extends from the back of the E into the central arm and almost up to the edge of the free end thereof.

3. An ignition unit according to claim 2, wherein the packs of plates are identical.

4. An ignition unit according to claim 2, wherein air gaps are formed between the corresponding end arms of the packs of plates.

5. An ignition unit according to claim 1, wherein inserts of non-magnetic material are disposed in recesses or notches defined between the two ring-shaped portions of the assembly formed by the packs of plates.

6. An ignition unit according to claim 1, wherein the packs of plates are clamped together by means of a clip or clamp device disposed around recesses or notches defined between the two ring-shaped portions of the assembly formed by the packs of plates.

7. An ignition unit according to claim 1, wherein the packs of plates are force-fitted in a casing of non-magnetic material which is preferably electrically conductive.

8. An ignition unit according to claim 5, wherein the non-magnetic material is aluminum.

9. An ignition unit according to claim 7, wherein the casing has integral cooling fins.

10. An ignition unit according to claim 5, wherein the inserts of non-magnetic material are integral with the casing.

11. An ignition unit according to claim 2, wherein the primary and secondary windings of each ignition coil are wound coaxially on respective spools arranged one within the other, the primary winding being disposed within the secondary winding and the spool of the primary winding being tubular and closed at its ends by integral, breakable partitions;

each ignition coil being located in a portion of the interior of a dish-like insulating housing whose side walls facing the ends of the spools of the primary windings are also formed as thin, breakable partitions;

a settable liquid insulating material being poured into the dish-like housing to fill the spaces between the housing and the ignition coils, the end arms of the packs of plates subsequently being inserted in the spools of the primary windings after the breakable partitions of the housing and the spools have been knocked out.

12. An ignition unit according to claim 1, wherein the primary and secondary windings in each ignition coil are arranged coaxially around an inner spool with open ends, and each ignition coil is located in a respective portion of the interior of a dish-like insulating housing whose side walls which face the ends of the innermost spool have respective apertures between which a tubular element extends through the innermost spool, the ends of the tubular element being sealed to the edges of the apertures in the dish-like housing.

13. An ignition unit according to claim 11, wherein the dish-like housing defines two adjacent cells each of which houses a respective ignition coil, and the central arms of said packs of plates forming the magnetic core extend outside the housing, in the region between adjacent walls of the cells.

14. An ignition unit according to claim 11, wherein the dish-like housing has fins for dissipating heat.

15. An ignition unit according to claim 11, wherein a support and closure member, also of insulating material, is positioned in the dish-like housing over the ignition coils and comprises an elongate base plate whose face which faces out of the housing carries a plurality of high-voltage terminals or outputs each adapted to be connected mechanically and electrically to a respective spark plug;

conductors for connecting the secondary windings of the ignition coils to the terminals being provided in the dish-like housing beneath the support and closure element;

said insulating, filler material being poured in in the liquid state so as to fill the region below the closure and support member and so as to cover the surface of the closure and support element which faces out of the housing to a predeterined depth.

16. An ignition unit according to claim 15, wherein the closure and support member also has at least one integral support wall which projects into the housing from one side of the base plate and to which the ignition coils are anchored.

17. An ignition unit according to claim 16, wherein the support wall has holes for engagement by locating projections or pins for the ignition coils.

18. An ignition unit according to claim 17, wherein the locating projections or pins are constituted by axial end projections of a plastic spool of each ignition coil, the locating pins or projections projecting beyond the support wall of the closure and support member and being deformed plastically so as to connect the ignition coils firmly to the walls.

19. An ignition unit according to claim 11, wherein a casing of non-magnetic material is force-fitted to the outside of the dish-like housing.

20. An ignition unit according to claim 19, wherein holes are formed in the casing of non-magnetic material and in each of the packs of plates for the passage of screws or similar members for fixing the unit to an internal combustion engine.

* * * * *